United States Patent [19]

Lytle

[11] 4,183,170

[45] Jan. 15, 1980

[54] TOY WHEEL RUNWAY

[76] Inventor: Rex L. Lytle, 2307 W. Kiowa St., Colorado Springs, Colo. 80904

[21] Appl. No.: 850,203

[22] Filed: Nov. 10, 1977

[51] Int. Cl.[2] ..... A63H 5/00

[52] U.S. Cl. ..... 46/114; 46/220

[58] Field of Search ..... 46/220, 205, 114, 50, 46/202, 47

[56] References Cited

U.S. PATENT DOCUMENTS

| | | | |
|---|---|---|---|
| D. 170,677 | 10/1953 | Chrisco | 46/220 X |
| 1,005,853 | 10/1911 | Lewis | 46/236 |
| 2,678,515 | 5/1954 | Desiderio | 46/47 |
| 2,976,645 | 3/1961 | Hight et al. | 46/220 |
| 3,078,620 | 2/1963 | Frye, Jr. et al. | 46/220 |

*Primary Examiner*—Russell R. Kinsey

*Assistant Examiner*—Mickey Yu

*Attorney, Agent, or Firm*—W. Britton Moore

[57] ABSTRACT

A toy wheel runway including a vertically disposed hollow body member with a flat base and closed upper end with a projecting handle thereon, and having an open front and an elongated slot in its rear wall. Spaced track forming ribs are longitudinally arranged within the body laterally of the slot to accommodate an axled wheel member therebetween, with the ribs being notched adjacent their upper ends to receive and retain the wheel axles therein so that, when the body member is tilted relative to a flat surface and the wheel is lifted to free the axles from the notches, the wheel will gravitationally roll over the ribs and be propelled from the lower end for free rolling over the flat surface.

4 Claims, 6 Drawing Figures

TOY WHEEL RUNWAY

This invention relates to a toy runway adapted to be vertically disposed on a flat surface and including a slotted handled body member having spaced track forming ribs therein for supporting an axled wheel member therein whereby tilting of the body member releases the wheel for gravitational rolling of the axles thereof over the ribs for free rolling over the flat surface.

The principal object of the present invention is to provide a relatively compact toy runway easily handled by and for the amusement of a child and including a slotted hollow body member disposable upright on a flat surface and having spaced notched track forming ribs therein for supporting the axles of a small wheel therein and thereon, and wherein the lower end of the body is curved so that tilting of the body member and lifting of the wheel axles from the rib notches permits gravitational rolling over the ribs and curved lower end and propelling of the wheel therefrom for free rolling over the surface.

Another object is the provision of a toy runway having an elongated generally rectangular hollow body member with a flat base and closed upper end with a projecting handle thereon, wherein the front is open and the rear wall is longitudinally slotted, and spaced track forming ribs are longitudinally arranged within the body laterally of the slot so that tilting of the body member relative to a flat surface and positioning of an axled wheel between and the axles thereof on the ribs permits free gravitational rolling of the wheel axles thereover and from the lower end thereof for rolling over the surface.

A further object is to provide a toy runway wherein the base is flat and has a side wheel guiding surfaces thereon so that when the wheel rolls over the track forming ribs and the curved lower surface of the hollow body and is propelled therefrom it will be guided over the surface.

Still another object is to provide a wheel with finger engaging recesses in the side walls thereof, a flat tread, and narrow hubs with flat side walls and axles projecting therefrom to enable the hubs to engage with the inner walls of the track ribs as the axles roll thereover.

A still further object is the provision of arcuate pellet receiving pockets in the side walls of the wheel for receiving noise making pellets.

These and other objects and advantages will be apparent as the specification is considered with the accompanying drawings, wherein FIG. 1 is a perspective view of the toy runway with a wheel in descending position on the track forming ribs;

Figure 1:
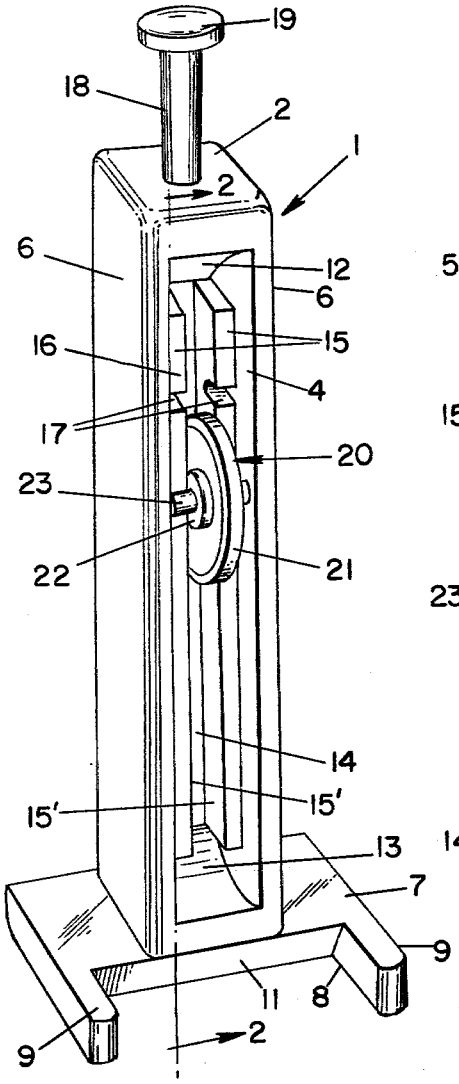
Figure 2:
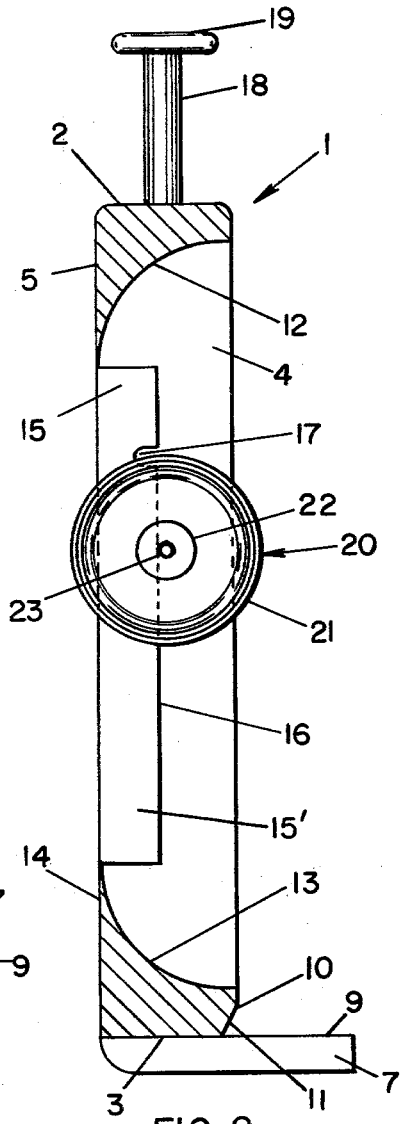
FIG. 2 is a section on the line 2—2 of FIG. 1.
Figure 3:
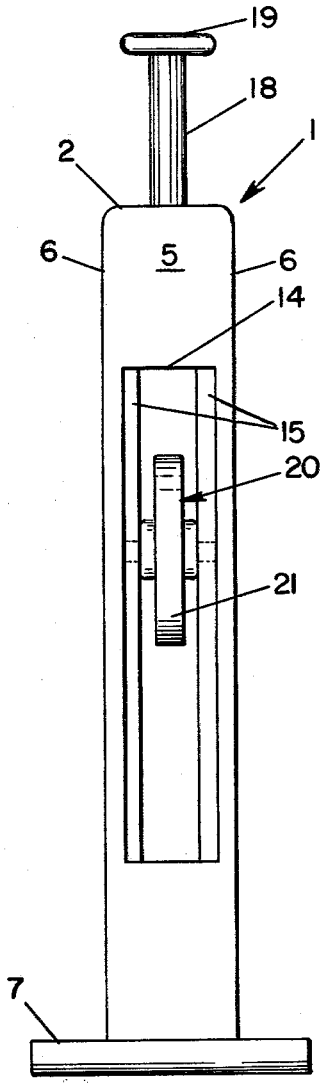
FIG. 3 is a rear view.
Figure 4:
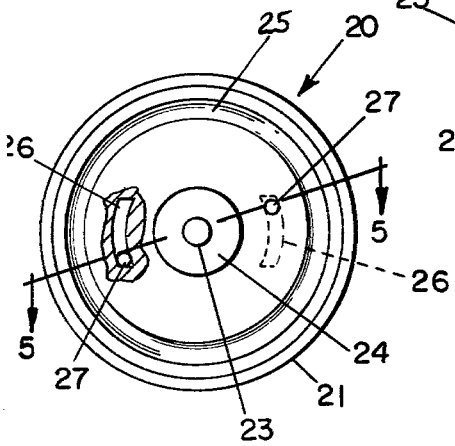
FIG. 4 is a side view of a wheel.
Figure 5:
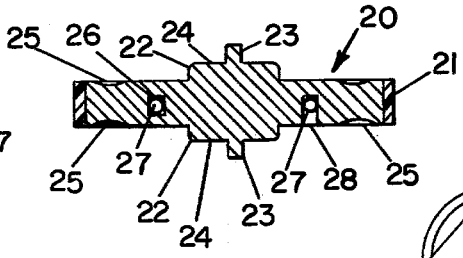
FIG. 5 is a section on the line 5—5 of FIG. 4.
Figure 6:
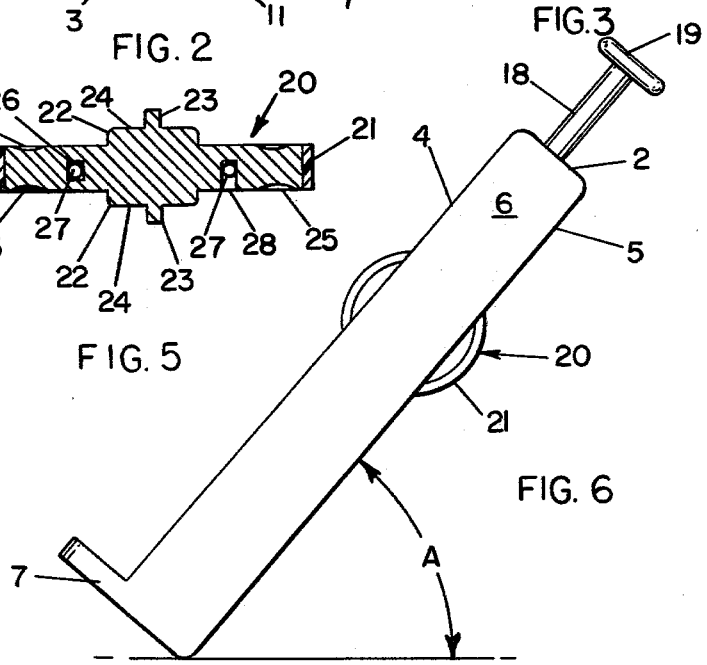
FIG. 6 is a side elevation.

Referring more particularly to the drawings, wherein similar reference characters designate like parts throughout the several views, numeral 1 indicates an elongated generally rectangular hollow body member having upper and lower ends 2 and 3, open front 4, rear wall 5, and side walls 6. The lower end 3 is supported by a somewhat enlarged flat base member 7 having its front recessed, as at 8, to provide a pair of spaced guiding arms 9 and wherein the front edge 10 of recess 8 slopes downwardly and inwardly, as at 11. Interiorly of the upper and lower ends 2–3, the inner body wall curves inwardly and downwardly at its upper end as at 12, and inwardly and upwardly at the lower end, as at 13, respectively. Rear wall 5 of the body has an elongated slot 14 terminating at the lower and upper ends of curved interior walls 11 and 12, as best shown in FIG. 3.

A pair of flat, relatively narrow, parallel tracks or ribs 15 are spacedly arranged within the hollow body, at the side edges of slot 14, and are suitably secured or adhesively adhered to the inner side walls 6. The opposing ends of the track 15 also terminate at the respective ends of the curved interior walls 11 and 12, so that the tracks will project into the hollow body, but be spaced inwardly of the open front 4 thereof. Aligned notches 17 are formed in top edges 16 of the tracks below the upper ends thereof, and the top edges are flat, for a purpose to be hereinafter described.

Projecting upwardly centrally from the upper end 2 of body member 1 is a relatively short tubular post 18 formed with a flat circular disc 19, which functions as a handle or grip to facilitate handling and tilting of the runway.

A solid, one-piece wheel 20 of suitable light weight material, and of a diameter somewhat larger than the depth of hollow body 1, is formed with a flat tread 21, lateral projecting hubs 22, and small diameter axles 23. Hubs 22 are relatively narrow and are formed with flat outer walls 24 to enable positioning thereof between the inner side walls 15' of the tracks when the wheel 20 is inserted therebetween, at which time the axles 23 will engage with and rest upon top edges 16 of the tracks. An annular circumferential groove 25 is formed in each flat side wall inwardly of the annulus thereof to enable finger grasping and handling thereof, in an obvious manner. In addition, at least two spaced, arcuate pockets or channels 26 are formed interiorly of wheel 20 of a size to moveably accommodate pellets 27 of any suitable material, such as metal, which may be forceably introduced thereinto through reduced entry bores 28 so as not to be escapable therefrom. It will, of course, be apparent that during rotation of the wheel, the pellets will engage the end walls of the pockets 26 and produce an audible clicking sound. If desired, two or more pellets may be so arranged therein.

In use, the body member 1 is either disposed horizontally on the flat surface with the open front thereof uppermost, or it is inclined at a slight angle thereto, so that wheel 20 may be fitted between tracks 15 and the axles 23 thereof inserted within track notches 17. Thereafter, the device may be inclined at a steep angle, by one hand grasping handle 19, and the fingers of the other hand employed to lift the wheel and free the axles thereof from notches 17, and the wheel released. Thus, the wheel will gravitationally roll downwardly between the tracks and the axles will roll on the flat top edges 16 thereof until the wheel contacts and is directed outwardly of the lower end by curved surface 13, in an obvious manner. The arms 9 will act to guide the wheel as it is ejected from the body member, and the angled face 11 at the front of base 7 will tend to prevent the wheel abruptly dropping onto the flat surface. The speed of descent of the wheel may, of course, be controlled by increasing or decreasing the angle at which the device is disposed relative to the flat surface.

While a preferred embodiment has been shown and described, it is to be understood that various changes and improvements may be made therein without departing from the scope and spirit of the appended claims.

What is claimed:

1. A toy runway comprising an elongated hollow body member having closed upper and lower ends, a rear wall, and an open front, a flat base for said member, handle means at the upper end thereof with knob means thereon, an elongated slot in said rear wall, spaced parallel flat rib track means in said hollow body member arranged adjacent to said slot, said upper and lower ends of said hollow body being curved upwardly and outwardly and downwardly and outwardly, respectively, and a wheel having a hub and axle means thereon, said rib track means having notches adjacent the upper ends thereof, said wheel being positioned relative to said track means with the axle means thereon and arranged and retained in said notches, whereby when the flat base of said body member is tilted at an angle relative to a flat surface and said wheel is released and freed from said notches it will gravitationally descend on said rib track means and be ejected from the lower end of said body member.

2. In a toy runway, according to claim 1, wherein said wheel has an annular circumferential groove inwardly of the annulus in each side wall to enable finger grasping and handling thereof.

3. In a toy runway, according to claim 2, wherein said wheel has a flat tread and interior arcuate pockets with noise creating pellets therein.

4. In a toy runway, according to claim 1, wherein said base is recessed to provide spaced projecting guide arms, and the forward edge of said recess is sloped downwardly and inwardly to facilitate ejection of said wheel therefrom.

* * * * *